United States Patent [19]

Canavan

[11] 4,008,786

[45] Feb. 22, 1977

[54] SUPPORT FOR ELONGATED WOODEN PLANKS AND THE LIKE

[75] Inventor: Joseph M. Canavan, Hermiston, Oreg.

[73] Assignee: The Raymond Lee Organization, Inc., a part interest

[22] Filed: Sept. 15, 1975

[21] Appl. No.: 613,109

[52] U.S. Cl. ..... 182/186; 182/151

[51] Int. Cl.[2] ..... F16M 11/00

[58] Field of Search ..... 182/181, 182, 183, 184, 182/185, 186, 226, 224, 225, 118, 119, 228, 151; 403/257

[56] References Cited

UNITED STATES PATENTS

| | | | |
|---|---|---|---|
| 2,416,950 | 3/1947 | Pohrman | 182/186 |
| 2,458,076 | 1/1949 | Houston | 182/205 |
| 2,829,927 | 4/1958 | Sword | 182/181 |
| 3,005,513 | 10/1961 | Larson | 182/108 |
| 3,139,950 | 7/1964 | Bormann | 182/119 |
| 3,180,663 | 3/1965 | Lehmann | 403/257 |
| 3,212,606 | 10/1965 | Opaw | 182/186 |

*Primary Examiner*—Reinaldo P. Machado

[57] ABSTRACT

A support has two like, elongated, opposed and upwardly and symmetrically inwardly extending legs, each of which supports a flexible protective tip at its bottom end. Two horizontally elongated parallel bars extend between the legs, each of the bars being hollow and square in cross-section.

3 Claims, 4 Drawing Figures

30
30
80

20°
20°
20
90
20
60

III
30

40
50
10
30
17°
10
17°
30
20
III
30
80
70
20

30

SUPPORT FOR ELONGATED WOODEN PLANKS AND THE LIKE

SUMMARY OF THE INVENTION

This invention is directed towards providing a support for elongated planks that is easy to assemble and to break down, and that does not require much room to store.

In this invention, two like, elongated, opposed and upwardly and symmetrically inwardly extending legs are connected by two horizontally elongated parallel bars. A conventionally shaped wooden plank can be thrust between the bars, and will be firmly supported when the lower ends of the legs are placed on the floor or other horizontal surface. Two such supports can be used to elevate an entire plank parallel to the floor, and a second plank may be laid atop the top bars of the two supports to increase the elevation provided by the assembly.

DETAILED DESCRIPTION OF PREFERRED EMBODIMENTS

Figures 1, 2, 3, 4:
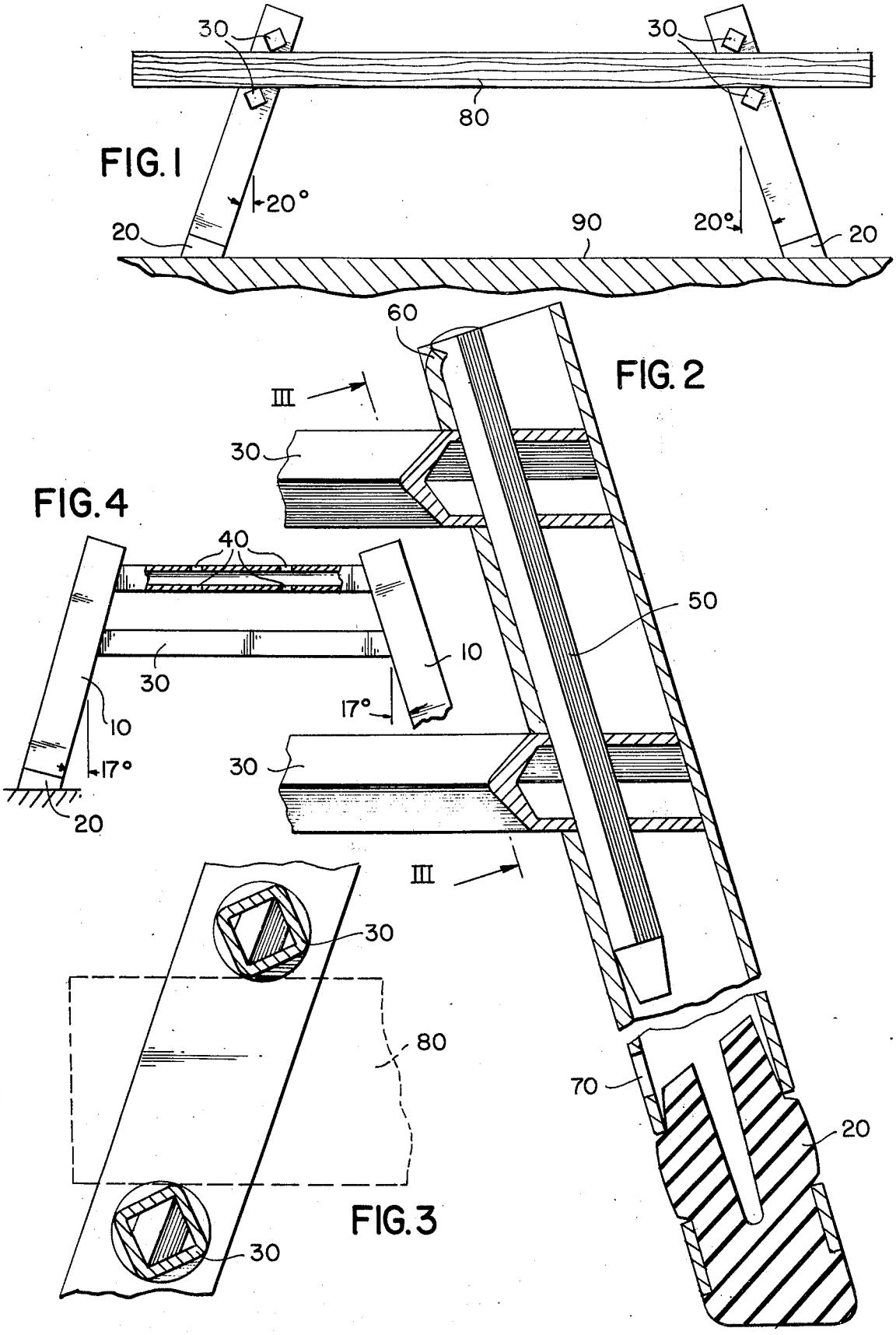
FIG. 1 is a side cross sectional view of the invention in use.
FIG. 2 is a front cross sectional veiw of a portion of the invention.
FIG. 3 is a side cross sectional view of a portion of the invention.
FIG. 4 is a front view of the invention.

Two like, opposed, elongated, upwardly and symmetrically inwardly extending lags 10 are coplanar, but are inwardly inclined at approximately 17° with respect to the vertical. The legs are made of hollow tubing, and each has a flexible protective tip 20 at its lower end.

Between the legs extend two horizontally elongated, coplanar bars 30. The bars are hollow and square in cross section, and the upper bar has two pairs of vertically aligned holes 40 drilled into its walls.

The ends of the bars are drilled with aligned holes that have a common central axis that is inclined 17° to the vertical. As is shown in FIG. 2, the bars are held inside the legs by an elongated locking pin 50 that extends through the holes in the bars inside each leg.

The pin itself is held inside the leg by denting a portion 60 of the leg wall inwardly into a V notch near the top of the pin.

Since the legs are hollow, foreign matter, such as water or debris, can fill into the top and accumulate inside the leg. A certain portion of the debris falls into the grooves between tips and legs locking the tips in place. A hole 70 near the bottom of each leg above the tip allows the water to drain out out of the leg.

As is shown, an elongated wooden plank 80 can be placed between the bars of two of the supports, supporting the board in a horizontal plane above a horizontal floor 90. The holes 40 allow screws to be threaded into the plank to join the plank and the supports together. It has been found that when the distance between the bars is ⅛ inch greater than the thickness of the plank placed between them, the supports will lean towards each other at an angle of 20° to the vertical. This inclination increases the stability of the arrangement.

While the invention has been described with detailed reference to the drawings, the protection sought is to be limited only by the terms of the claims which follow.

I claim:

1. A support for an elongated wooden plank, comprising:

two like, hollow elongated, opposed and upwardly and symmetrically inwardly extending legs;

two like flexible protective tips, each located in the bottom end of a corresponding leg;

two horizontally elongated parallel bars which are hollow and square in cross-section, extending between the legs; and two like, elongated locking pins, each pin being located inside a corresponding leg and extending through aligned holes in each of the bars to secure the bars to the leg.

2. The device of claim 1 wherein the locking pins are held in position by a V notch shaped dent in each of the legs.

3. The device of claim 2 wherein the distance between the bars is ⅛ inch greater than the thickness of the plank that is to be placed between them, whereby the legs will be inclined 20° to the vertical when the plank is horizontal.

* * * * *